US008222551B2

(12) United States Patent
Wong et al.

(10) Patent No.: US 8,222,551 B2
(45) Date of Patent: Jul. 17, 2012

(54) ELECTRICAL SWITCH WITH CASING AND HOLDER MOUNTABLE ON THE CASING

(76) Inventors: Memie Mei Mei Wong, Hong Kong (CN); Sam Yun Sum Wong, Hong Kong (CN)

( * ) Notice: Subject to any disclaimer, the term of this patent is extended or adjusted under 35 U.S.C. 154(b) by 218 days.

(21) Appl. No.: 12/824,351

(22) Filed: Jun. 28, 2010

(65) Prior Publication Data

US 2011/0315531 A1 Dec. 29, 2011

(51) Int. Cl.
*H01H 1/64* (2006.01)

(52) U.S. Cl. ..... 200/293

(58) Field of Classification Search ..... 200/11 TC, 200/179, 293, 51.17, 570
See application file for complete search history.

(56) References Cited

U.S. PATENT DOCUMENTS

| | | | | |
|---|---|---|---|---|
| 3,748,419 | A * | 7/1973 | Torrey et al. | 200/570 |
| 6,255,926 | B1 * | 7/2001 | Gundy et al. | 335/202 |
| 2012/0038221 | A1 * | 2/2012 | Petursson et al. | 307/105 |

* cited by examiner

*Primary Examiner* — Vanessa Girardi
(74) *Attorney, Agent, or Firm* — Leydig, Voit & Mayer, Ltd.

(57) ABSTRACT

An electrical switch has a casing, four fixed contacts, a moving contact located in the casing, and an operator supported by the casing for movement moving the moving contact into and out of contact with the fixed contacts. The casing has an aperture adjacent each fixed contact, through which an end of an electrical cable may be inserted for connection to the fixed contact. The aperture faces in a first direction, laterally outwards from the casing. The electrical switch includes a holder located on the casing immediately outside the aperture for holding an electrical cable connected through the aperture, bent, and extending in a second direction transverse to the first direction.

14 Claims, 3 Drawing Sheets

ELECTRICAL SWITCH WITH CASING AND HOLDER MOUNTABLE ON THE CASING

The present invention relates to an electrical switch and in particular, but not exclusively, to a rotary switch.

BACKGROUND OF THE INVENTION

In light of the general trend to make products ever more compact, internal space poses an ever increasing problem and components that were used in the past can no longer be, or at least find it difficult to be, accommodated in the new designs.

Electrical switches belong to a type of products which are faced with such a challenge. Whilst there is some scope, though only to a limited extent, for reducing the size of the switches themselves, the electrical cables connected thereto must remain generally as thick in order to carry the same magnitude of electrical current for maintaining the power rating of the switches.

The invention seeks to mitigate, or to at least alleviate, the aforesaid problem by providing a new or otherwise improved electrical switch.

SUMMARY OF THE INVENTION

According to the invention, there is provided an electrical switch comprising a casing, at least one fixed contact and at least one moving contact located in the casing, and an operator supported by the casing for movement to move the moving contact into or out of contact with the fixed contact for switching. The casing has an aperture adjacent the fixed contact, through which an end of an electrical cable may be inserted for connection to the fixed contact. The aperture faces in a first direction laterally outwards from the casing. The electrical switch includes a holder adapted to be located on the casing immediately outside the aperture for holding an electrical cable connected through the aperture bent and extending in a second direction transverse to the first direction.

Preferably, the holder is locatable on the casing externally of the aperture in the first direction.

Preferably, the aperture is open on a first side facing in the first direction and on an adjoining second side facing in the second direction. The second side of the aperture is adapted to accommodate an electrical cable connected through the first side of the aperture and then bent to the second side.

Preferably, the holder includes at least one latching part for latching the holder on the casing.

In a preferred embodiment, the electrical switch includes a plurality of said fixed contacts, and the casing has respective apertures adjacent the fixed contacts through which the ends of respective electrical cables may be inserted for connection to the corresponding fixed contacts. Also, the holder is adapted to hold all such electrical cables connected through the respective apertures bent and extending in generally the same second direction.

More preferably, the holder has a plurality of holding parts, each for holding an electrical cable connected through a respective one of the apertures bent and extending in generally the same second direction, and a body part connecting all the holding parts to result in a one-piece structure.

It is preferred that the holding parts protrude at different positions from a periphery of the body part and to one side of the body part, together forming a shell structure for the holder to fit onto the casing.

It is preferred that the casing has a bottom side from which said electrical cables are to extend in generally the same second direction, and the holder has a shape matching with that of the bottom side for fitting onto the casing on the bottom side.

It is further preferred that the holder has a plurality of holes for said electrical cables to extend through individually in generally the same second direction.

It is yet further preferred that the holes are provided by the hollows of respective tubular parts of the holder.

It is preferred that the casing has a top side and also a bottom side from which said electrical cables are to extend in generally the same second direction, and the holder has a shape matching with that of the top side for fitting onto the casing on the top side.

It is preferred that the electrical switch includes two first and second said holders, the casing having a top side and also a bottom side from which said electrical cables are to extend in generally the same second direction. The first holder has a shape matching with that of the bottom side for fitting onto the casing on the bottom side. The second holder has a shape matching with that of the top side for fitting onto the casing on the top side. The first and second holders together form a shell structure enclosing the casing.

It is further preferred that the first and second holders have respective latching parts inter-engaged to latch the holder on the casing.

In a specific embodiment, the casing has a top side on which the operator is provided and a bottom side from which said electrical cable is to extend in the second direction.

More specifically, the electrical switch includes at least two fixed contacts disposed around the moving contact, and the operator comprises a shaft arranged to turn the moving contact relative to the fixed contacts for switching. Also, the shaft extends from the top side of the casing in a direction opposite to the second direction.

BRIEF DESCRIPTION OF DRAWINGS

The invention will now be more particularly described, by way of example only, with reference to the accompanying drawings, in which.

DETAILED DESCRIPTION OF THE INVENTION

Figure 1:
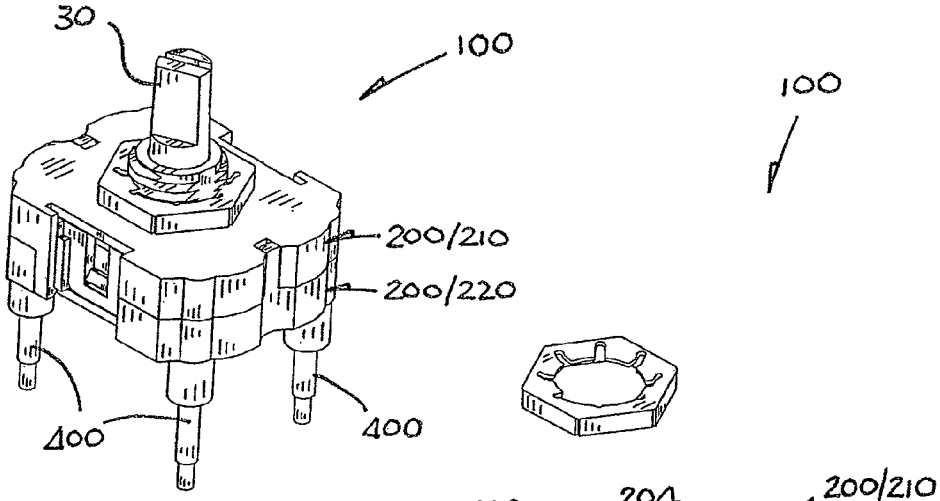
FIG. 1 is a perspective view of an embodiment of an electrical switch in accordance with the invention.
Figure 2:
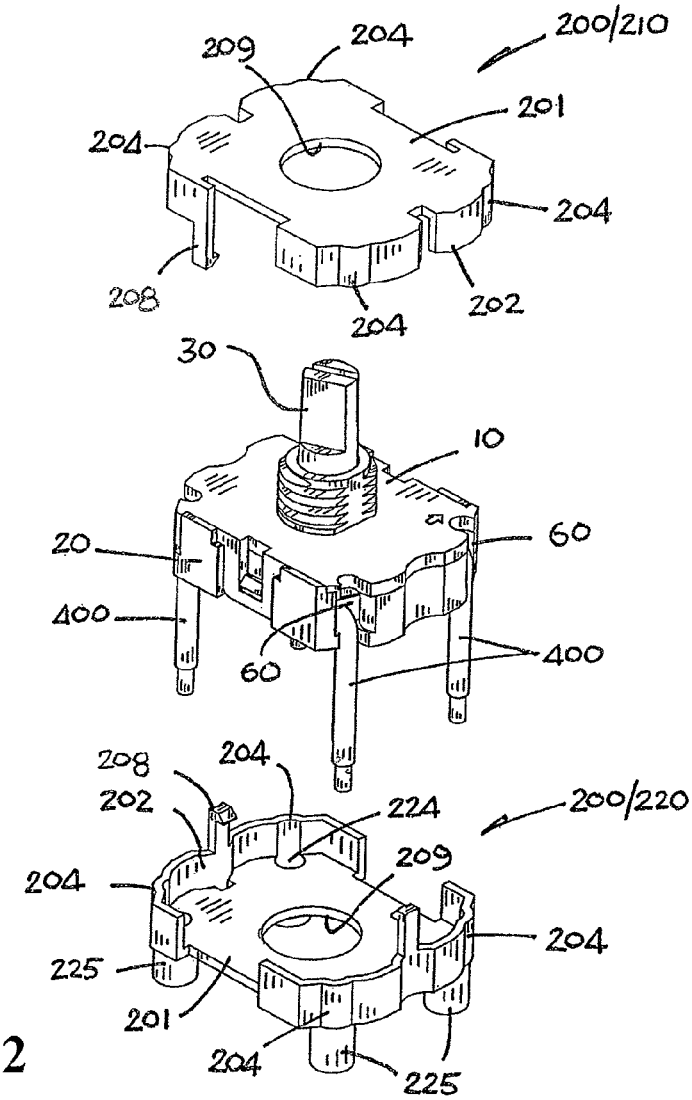
FIG. 2 is an exploded perspective view of the electrical switch of FIG. 1, including a pair of holders for electrical cables connected thereto.
Figure 3:
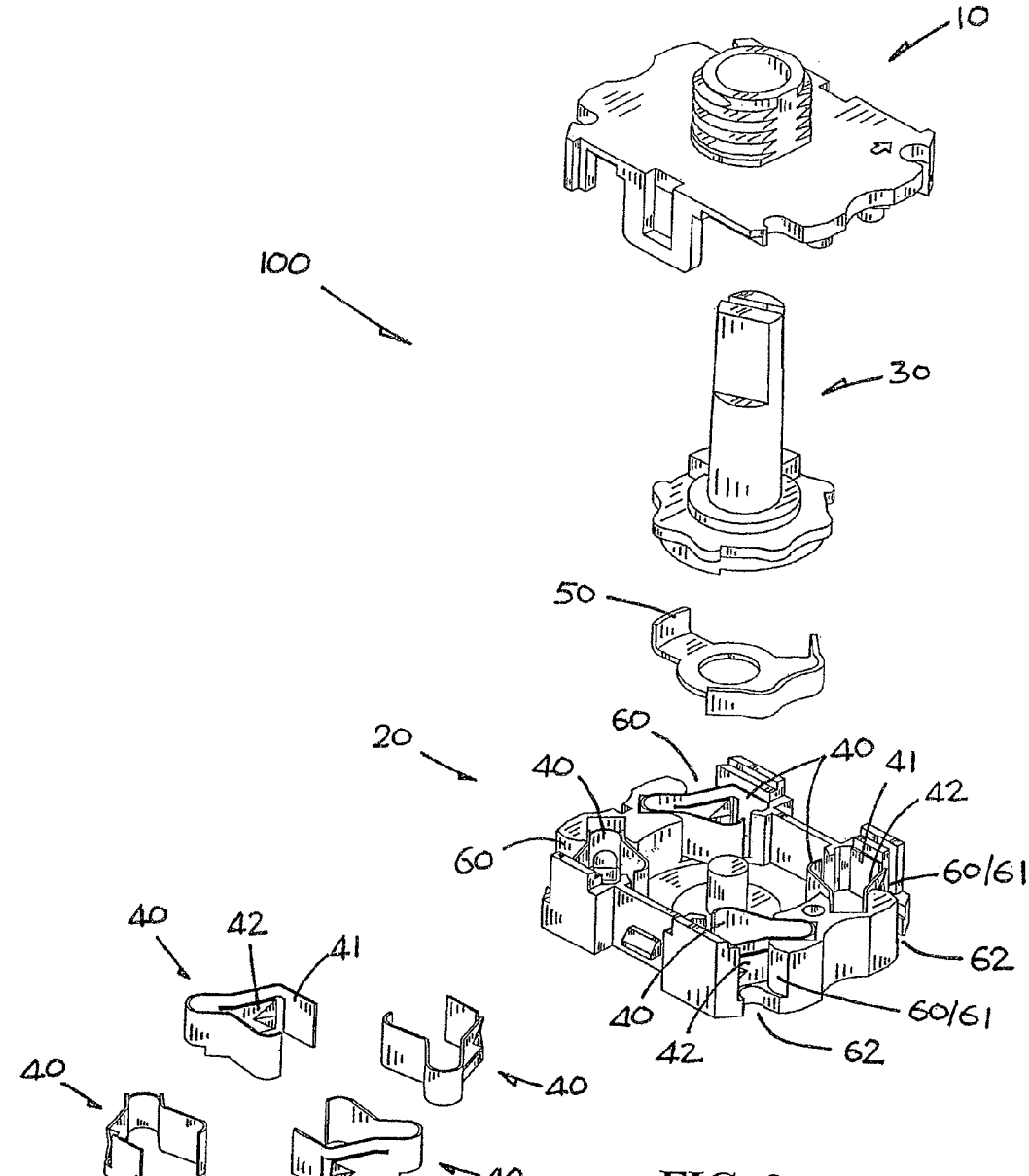
FIG. 3 is a further exploded perspective view of the electrical switch of FIG. 2, excluding the holders.
Figure 4:
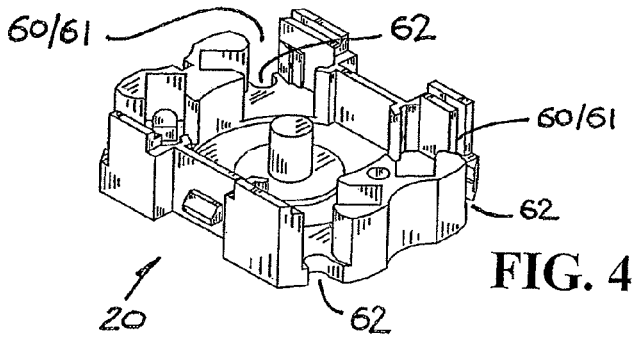
FIG. 4 is an exploded perspective view of part of the electrical switch of FIG. 3.

Referring to the drawings, there is shown an electrical switch in the form of a rotary switch 100 embodying the invention, which has a casing 10/20 formed by upper and lower casing parts 10 and 20 latched together, four fixed contacts 40 and a moving contact 50 located in the casing 10/20, and an operator in the form of a central shaft 30 supported by the casing 10/20 for rotation to turn the moving contact 50 into or out of contact with the fixed contacts 40 for performing a switching action. A turning knob is usually connected to the upper end of the shaft 30 to facilitate operation, but it is omitted for clarity.

As is shown in the drawings, the casing 10/20 has a top side on which the shaft 30 is provided and from which the shaft 30 extends in an upward direction, and a bottom side. The casing 10/20 has a generally flat rectangular shape. The four fixed contacts 40 are disposed at respective corners of the casing 10/20 around the moving contact 50, which is mounted on a lower end of the shaft 30 for rotation thereby.

The casing 10/20 includes four apertures 60 in its corners, each adjacent a respective fixed contact 40, through which an end 401 of an electrical cable 400 may be inserted for connection to the respective fixed contact 40. The casing 10/20 has a peripheral side around it, on which the apertures 60 are formed, each facing in a respective lateral direction (i.e. first direction) laterally outwards from the casing 10/20.

Each fixed contact 40 is provided by a bent copper strip having a free end 41 and an adjacent tab 42 which is partially cut to be bendable away from the plane of the relevant part of the copper strip. The cable end 401 will upon insertion be automatically clamped by the tab 42, while pushing and bending the tab 42 inwards, against the free end 41 of the associated fixed contact 40.

While four electrical cables 400 are connected to the switch 100, they extend and project laterally from the switch casing 10/20 in different directions, at least two opposite directions to the front and back for the described embodiment. The footprint of the connected switch 100 is considerably increased, and this may not be accommodated in the reducing amount of internal space available as electrical appliances/products become ever more compact.

It is often tidy for the cables 400 to extend away from the switch 100 as a bundle before they reach the circuit board and/or part and run to different components. The way the cables 400 initially extend in different directions from the casing 10/20 does not help. The cables 400 are sometimes bent down and bundled together on the bottom side of the switch 100 first, but the bends of the cables 400 being loose still take up some not insignificant space around the casing 10/20.

To solve this problem, the electrical switch 100 incorporates a holder 200 which is adapted to be located on the casing 10/20 immediately outside the aperture 60 for holding all the connected cable 400 bent and extending in generally the same downward direction (i.e. second direction) transverse to the lateral directions in which the cables 400 initially extend from the casing 10/20.

Returning briefly to the apertures 60, each of them is open on a first side 61, i.e. the peripheral side of the casing 10/20, facing in the lateral direction for the insertion of an electrical cable 400, and on an adjoining second side 62, i.e. the bottom side of the casing 10/20, facing in the downward direction. The second side 62 of the aperture 60 is adapted to accommodate the cable 400 connected through the first side 61 of the aperture 60 and then bent to the second side 62, without increasing the lateral size or footprint of the connected casing 10/20.

The holder 200 is in two parts, namely a first, upper holder 210 and a second, lower holder 220. The upper holder 210 has a shape matching with that of the top side or upper half of the casing 10/20 for fitting onto the upper half of the casing 10/20 on the top side. The lower holder 220 has a shape matching with that of the bottom side or lower half of the casing 10/20 for fitting onto the lower half of the casing 10/20 on the bottom side. The upper and lower holders 210 and 220 together form a shell structure which encloses the casing 10/20 from above and below.

The upper holder 210 has a flat rectangular body part 201 and a pair of relatively short walls 202 which are on and extend along opposite ends of the body part 201, on the same one (upper or lower) side of the body part 201. The opposite left and right end portions of each wall 202 each acts as a holding part 204. There are four such holding parts 204 in total, which are connected by the body part 201 to result in a one-piece structure.

The holding parts 204 protrude at different positions from the periphery of the body part 201 and to one side thereof, together forming a shell structure for the holder 210 to fit onto the casing 10/20. The holder 210 matches with and fits over the upper half of the casing 10/20, with the holding parts 204 at the left and right ends of each wall 202 aligned with the corresponding apertures 60 at the two corners of the relevant end of the casing 10/20. In particular, each holding part 204 is to be located on the casing 10/20 at a position immediately externally of the corresponding aperture 60, in the lateral direction in which a connected cable 400 extends off the casing 10/20.

Figure 5:
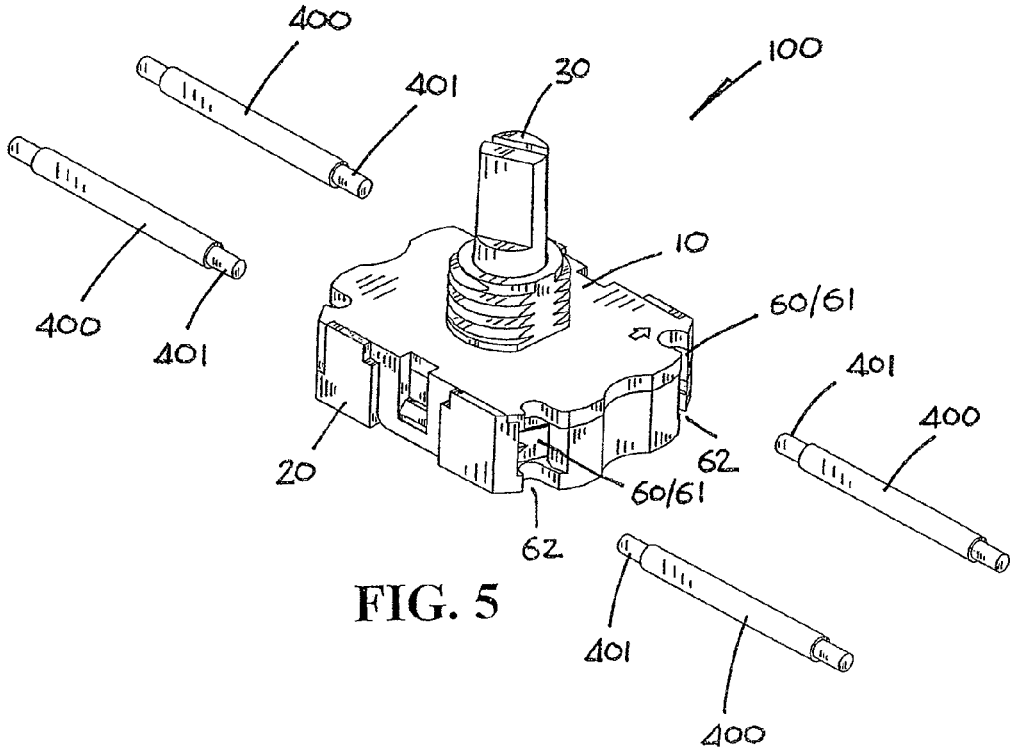
FIG. 5 is a perspective view of the electrical switch of FIG. 1, showing how electrical cables are connected to the switch.
Figure 6:
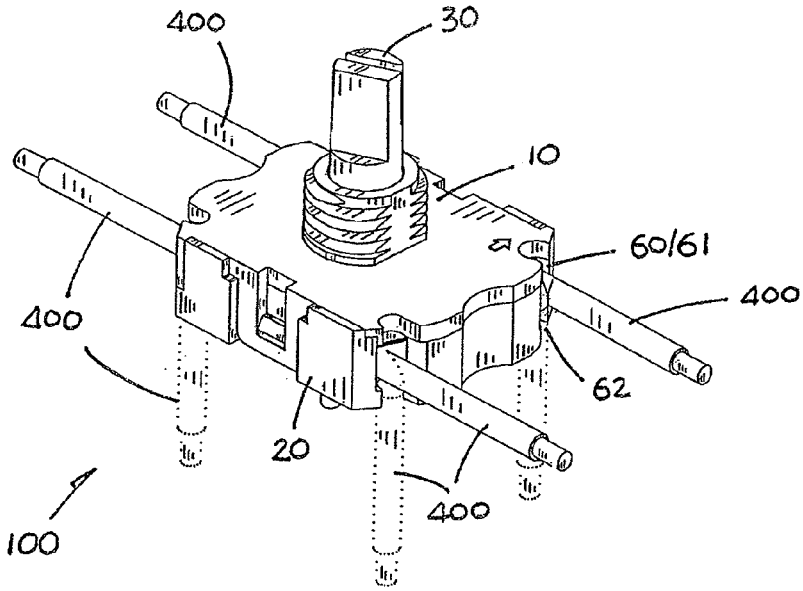
FIG. 6 is a similar perspective view of the electrical switch of FIG. 5, showing how the electrical cables are bent down after they have been connected to the switch.

Before the holder 210 is fit onto the casing 10/20, each of the four electrical cables 400 should be connected to the corresponding fixed contacts 40, with its end 401 inserted horizontally through the first side 61 of the corresponding aperture 60 (FIG. 5) and then bent downwardly through 90° (FIG. 6) such that the section of the cable 400 immediately outside the aperture 60 is pressed wholly into the aperture 60 and extends vertically out through the second side 62 thereof.

The second side 62 of the aperture 60 is adapted to accommodate the cable 400 such that it can stay in the aperture 60 before it extends vertically downwardly off the casing 10/20, without increasing the footprint size of the connected casing 10/20.

The holder 210 is then fit onto the upper half of the casing 10/20, with each of its holding part 204 holding the cable 400, connected through the corresponding aperture 60, bent and extending in generally the same downward direction.

The lower holder 220 has generally the same construction compared with the upper holder 210 but used upside down to fit onto the lower half of the casing 10/20, with equivalent parts designated by the same reference numerals. The upper holder 210 has a relatively large central hole 209 through its body part 201 for accommodating the shaft 30. The lower holder 220 likewise has a similar hole 209, but merely for material saving.

The major difference of the lower holder 220 lies in its inclusion of four holes 224 at respective corners for accommodating the connected cables 400, which extend through the holes 224 individually in generally the same downward direction. The holes 224 are provided by the hollows of respective tubular legs 225 projecting integrally, and vertically downwardly, from the body part 201. The legs 225 serve to protect and maintain the direction of the cables 400 near the casing 10/20.

Both holders 210 and 220 should, internally, be made almost or just half as thick as the casing 10/20 such that they can neatly enclose and fit on the casing 10/20 like a jacket. The upper holder 210 has a pair of hooks 208 depending from its longer edges, and the lower holder 220 has a pair of hooks 208 upstanding from its shorter edges, for engaging with the other holder 220/210 to thereby latch both holders 210 and 220 on the casing 10/20.

The hooks 208 may be unlatched for removal of the holders 210 and 200 to permit adding or changing of cable connection to the switch 100.

It is appreciated that the upper holder 210 alone if made thicker for example as thick as the casing 10/20, or the lower holder 220 alone, is sufficient to serve the purpose i.e. holding the connected cables 400 bent and extending downwardly. The lower holder 220 works more effectively because it engages the cables 400 from below, at a position farther away from where the cables 400 are connected to/by the fixed contacts 40, and because it is un-stretchable at where it engages the cables 400, i.e. along the plane of its body part 201.

In a simplest form suitable for use alone, the lower holder may be in the form of four rings inter-connected by links, each for holding a respective cable.

The invention has been given by way of example only, and various other modifications of and/or alterations to the described embodiment may be made by persons skilled in the art without departing from the scope of the invention as specified in the appended claims.

The invention claimed is:

1. An electrical switch comprising:

a casing;

at least one fixed contact and at least one moving contact located in the casing;

an operator supported by the casing for movement that moves the moving contact into and out of contact with the fixed contact, wherein the casing has an aperture adjacent the fixed contact through which an end of an electrical cable may be inserted for connection to the fixed contact, and the aperture faces in a first direction laterally outwards from the casing; and a holder mountable on the casing, spaced from and partially covering the aperture, wherein the holder includes a plurality of holes corresponding to respective electrical cables, and when the holder is mounted on the casing, an electrical cable that passes through one of the holes is electrically connected, through the aperture, to the fixed contact, is bent, and extends, through the one of the holes, in a second direction that is transverse to the first direction.

2. The electrical switch as claimed in claim 1, wherein the holder is mountable on the casing in the first direction.

3. The electrical switch as claimed in claim 1, wherein the aperture is open on a first side, facing in the first direction, and is open on a second side, adjoining the first side, facing in the second direction, the second side of the aperture accommodating the electrical cable connected to the fixed contact through the first side of the aperture and bent toward the second side.

4. The electrical switch as claimed in claim 1, wherein the holder includes at least one latching part for latching the holder to the casing.

5. The electrical switch as claimed in claim 1, wherein the holes comprise hollows of respective tubular parts of the holder.

6. The electrical switch as claimed in claim 1, wherein the casing has a top side on which the operator is located and a bottom side from which electrical cable extends in the second direction.

7. The electrical switch as claimed in claim 6, including at least two fixed contacts disposed around the moving contact, wherein the operator comprises a shaft for turning the moving contact relative to the fixed contacts, and the shaft extends from the top side of the casing in a direction opposite the second direction.

8. The electrical switch as claimed in claim 1, including a plurality of fixed contacts, wherein the casing has respective apertures adjacent corresponding fixed contacts and through which ends of respective electrical cables may be inserted for connection to corresponding fixed contacts, and the holder holds all of the electrical cables connected through the respective apertures so that the electrical cables are bent, extend generally in the second direction, and pass through respective holes in the holder.

9. The electrical switch as claimed in claim 8, wherein the holder has a plurality of holding parts, each holding part holding a respective one of the electrical cables connected through a respective one of the apertures, bent and extending generally in the second direction, and a body part connecting all of the holding parts in a one-piece structure.

10. The electrical switch as claimed in claim 9, wherein the holding parts protrude at different positions from a periphery of the body part, toward one side of the body part, the holding parts together forming a shell structure of the holder that fits onto the casing.

11. The electrical switch as claimed in claim 9, wherein the casing has a bottom side from which the electrical cables extend generally in the second direction, and the holder has a shape matching the bottom side for fitting onto the casing on the bottom side.

12. The electrical switch as claimed in claim 9, wherein the casing has a top side and a bottom side from which the electrical cables extend generally in the second direction, and the holder has a shape matching the top side for fitting onto the casing on the top side.

13. The electrical switch as claimed in claim 9, including first and second holders, wherein the casing has a top side and a bottom side from which the electrical cables extend generally in the second direction, the first holder has a shape matching the bottom side for fitting onto the casing on the bottom side, and the second holder has a shape matching the top side for fitting onto the casing on the top side, the first and second holders together forming a shell structure for enclosing the casing.

14. The electrical switch as claimed in claim 13, wherein the first and second holders have respective latching parts for latching the holder to the casing.

* * * * *